United States Patent [19]

Hollenbeck et al.

[11] 4,099,571

[45] Jul. 11, 1978

[54] DOWN HOLD PACKING GLAND AND METHOD FOR LONG STROKE PUMPER

[75] Inventors: Alfred L. Hollenbeck, Sultan; Alison V. De Tuerk; John T. Cooper, both of Everett, all of Wash.

[73] Assignee: Western Gear Corporation, Everett, Wash.

[21] Appl. No.: 776,950

[22] Filed: Mar. 14, 1977

[51] Int. Cl.[2] ..... E21B 33/03; E21B 23/00

[52] U.S. Cl. ..... 166/315; 166/84; 277/112

[58] Field of Search ..... 166/315, 0.5, 84, 82; 277/110, 112

[56] References Cited

U.S. PATENT DOCUMENTS

| | | | |
|---|---|---|---|
| 879,166 | 2/1908 | Haven | 166/84 |
| 2,674,474 | 4/1954 | Lister | 166/84 |
| 3,640,342 | 2/1972 | Gault | 166/84 |
| 3,662,829 | 5/1972 | Gault et al. | 166/84 |
| 3,744,567 | 7/1973 | Grable | 166/84 |

*Primary Examiner*—James A. Leppink
*Attorney, Agent, or Firm*—Seed, Berry, Vernon & Baynham

[57] ABSTRACT

A packing gland is positioned down within an oil well hole and is held in place by elastomeric sealing and locking devices which are actuated from above the hole through a torque tube. Rotation of the torque tube in one direction lowers the tube axially relative to the elastomers and causes them to expand radially thus locking and sealing the stuffing gland assembly in the well head equipment at a depth of about 100 feet below the ground surface. Counter rotation of the torque tube allows the elastomers to retract radially thus releasing the stuffing gland assembly. Once the stuffing gland assembly is released, a union joint assembly is moved downward relative to the stuffing gland assembly and a unique spring ring slides over a cylindrical boss on the packing gland assembly to couple the union joint assembly with the packing gland assembly. The packing gland assembly then is raised above the ground surface simultaneously with lifting the polish rod from the hole. A drain port is provided between the elastomer locking and sealing devices to provide a flow passage back into the well when the packing gland is removed allowing the portion of the casing housing the wire rope to drain dry.

10 Claims, 2 Drawing Figures

DOWN HOLD PACKING GLAND AND METHOD FOR LONG STROKE PUMPER

BACKGROUND OF THE INVENTION

1. Field of the Invention

This invention pertains to method and apparatus for positioning and removing down hole packing glands from oil well pumpers.

2. Description of the Prior Art

As is well known, depleted oil wells which no longer have a pressurized flow of oil into the bottom of the well hole can be forced into production by pumping another fluid such as steam or water into an adjacent hole so that the pressure of the fluid fractures the oil bearing strata and forces oil toward the depleted hole. The oil is then brought to the surface, as much as 10,000 feet or more above the bottom of the hole, by a conventional piston pump. The piston pump is reciprocated by 10,000 feet of sucker rod. The sucker rod is coupled to a polish rod which slides in a fixed stuffing tube assemelby that is fixed in the well head.

In order to obtain sufficient stroke of the piston pump and to accommodate the several feet of stretch in the sucker rod during each stroke it is necessary that the sucker rod and thus the polish rod be stroked several feet, preferably about 100 feet. In order to obtain this stroke length a large derrick can be erected over the well head with the polish rod sliding along a packing gland that is located approximately at the ground surface. The cost of such derricks are prohibitive.

A second technique is to put the packing gland some 100 feet down below the ground surface in a hole and then pump with a cable pump of the general configuration such as shown in U.S. Pat. No. 3,640,342 or any other conventional cable pump in which one end of the cable or wire rope is attached to the top of the polish rod and the other end after passing several turns around a powered reversibly rotated drum passes down to a counter weight in a parallel hole. The down hole packing gland, particularly when the packing gland is located 100 feet below the ground surface becomes difficult to inspect, tighten to accommodate wear and stop leakage, or to remove for repair or replacement. One attempt to solve this problem has been to fix the packing gland to the sucker rod and reciprocate the packing gland with the sucker rod during pumping strokes. This has not been a satisfactory solution. Another solution is to threadably connect the packing gland assembly to the surrounding stuffing tube. Because of these packing gland problems the down hole packing gland has not as yet been a satisfactory solution to the generally less expensive technique of pumping deep holes with a cable pumper.

SUMMARY OF THE INVENTION

It is an object of this invention to provide a down hole packing gland assembly which is readily positioned and readily removable for inspection and repair.

It is another object of this invention to provide a method and apparatus for installing, adjusting, and/or removing a down hole packing gland.

It is still another object of this invention to provide apparatus and a method for retrieving a down hole packing gland.

Basically these objects are obtained by releasably holding and sealing the packing gland down in the hole within a fixed stuffing tube using radially expandible elastomeric rings. The rings when axially compressed will expand to hole the packing gland tightly enough so that the gland remains stationary as the polish rod is reciprocated therein. Release of the gland for removal is accomplished merely by rotating a torque tube at the well head to remove the compressive force on the elastomeric rings and then hooking onto the packing gland assembly and pulling it up along with the polish rod. When the packing gland is removed a drain port is exposed to allow oil that is in the well flow casing above the drain port to flow back into the bottom of the well rather than into the chamber housing the wire rope. The advantage of this is that the wire rope does not get immersed in the well fluids making it easier to operate and keep clean. The torque tube is preferably about 4½ inch diameter pipe which can be turned easily by a workman with the use of a Stillson wrench. Locking of the gland and sealing is always positively assured since the workman can determine by the torque applied to the torque tube whether the elastomeric rings are properly expanded. Unlocking, of course, is also assured since the free rotation of the torque tube will indicate that the axial compressive force is removed from the elastomeric rings. In the preferred embodiment the torque tube is also provided with a bevelled surface which positively engages the packing gland to free it from the elastomeric rings.

Similarly the method of sealing and locking the packing gland is basically to position the gland assembly down in a hole around a polish rod of an oil well pumper, radially expanding an elastomeric seal and locking member into tight engagement between the packing gland and a stationary tube extending down from the top of the well hole, the step of expanding including rotating a second tube from above the ground surface and screwing the second tube downwardly into engagement with the elastomeric member for axially compressing the member to cause it to radially expand, unscrewing the second tube from above the ground surface to relax the elastomeric member and release the packing gland, withdrawing the packing gland by withdrawing the polish rod and draining the well fluids filling the passage occupied by the packing gland back down into the well hole.

As is readily apparent, the ability of a workman to positively activate or deactivate the locking and sealing member on the packing gland while it is 100 feet down in a hole while operating solely from the ground level enables removal of the packing gland for inspection and tightening in as short a time as 20 minutes and all occuring without spillage of the oil onto the ground surface. Actual replacement of the packing gland can also take place in a short time without removing its housing or if its housing also is to be replaced this can occur in a very short time due to a portion of the polish rod being separable from the main part of the polish rod.

The unique technique for grasping the packing gland assembly is essentially to use the union joint assembly of the polish rod-wire rope. This allows an extension of stroke operation for pumping to be utilized to attach to the packing gland assembly and withdraw it. This greatly facilitates removal and again reduces the amount of down time due to packing gland inspection, adjustment or repair.

DETAILED DESCRIPTION OF THE PREFERRED EMBODIMENTS

Figure 1:
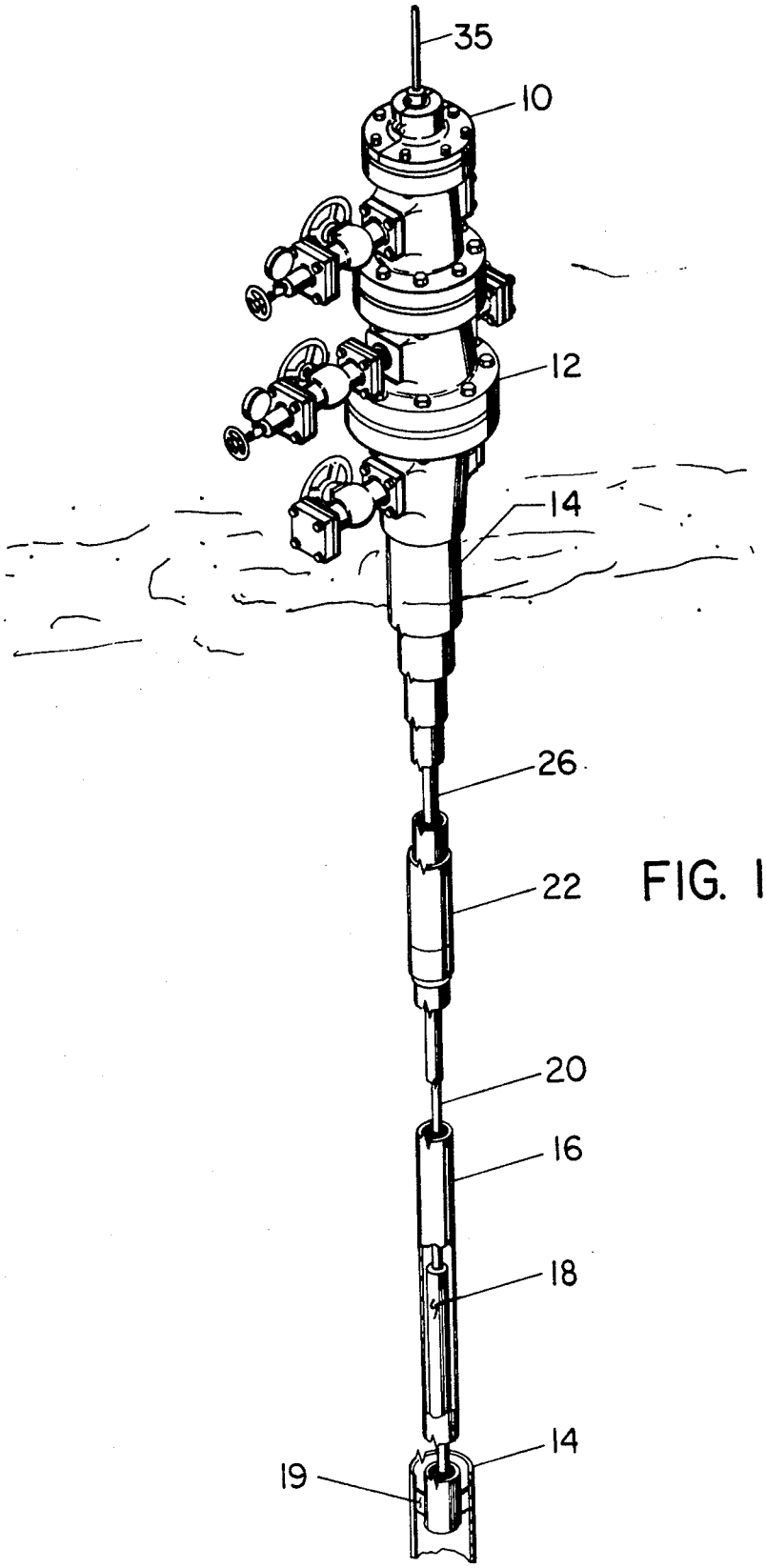
FIG. 1 is a schematic isometric view of a typical oil well hole with all of the equipment for raising the oil in the hole.
Figure 2:
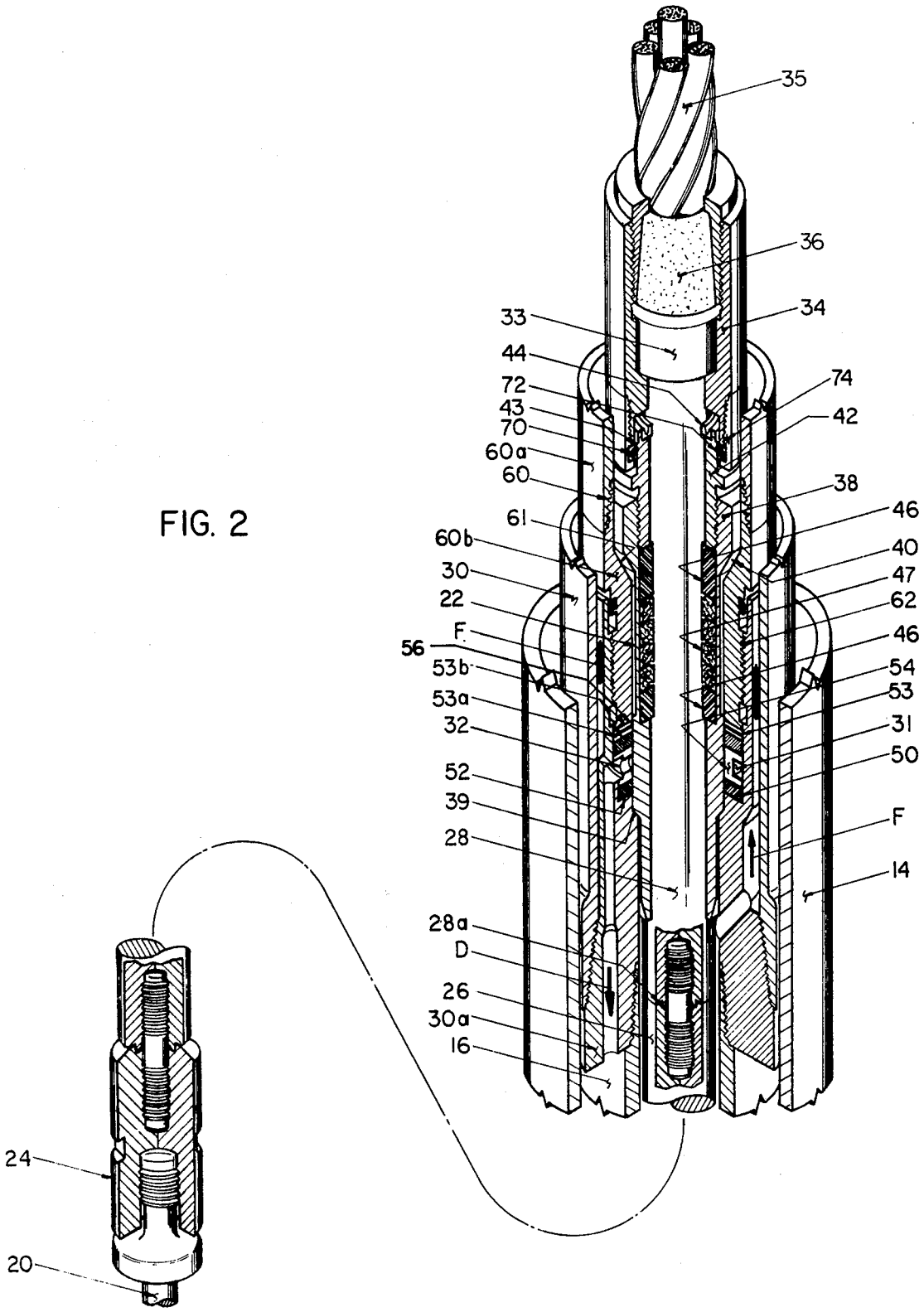
FIG. 2 is an enlarged isometric view of the equipment shown in FIG. 1 with parts broken away for clarity.

As best shown in FIG. 1 the well hole is provided with above-ground equipment generally comprising a split dust cover 10, and casing hangers, packers and other conventional well head equipment 12 the details of which are not necessary to an understanding of the invention. Extending below the ground there is an outer casing 14, a 3½ diameter production tubing 16, a conventional down-hole reciprocating piston pump 18 with an 80 foot stroke, a tubing anchor 19, a sucker rod 29 for operating the down-hole pump and a down-hole packing gland assembly 22. As best shown in FIG. 2 the sucker rod 20 is coupled through an adapter 24 to a six-piece polish rod 26. The polish rod is about 100 feet in length and includes a short, approximately 2 foot long pony rod 28 which is detachable at a joint **28*a*** from the rest of the polish rod.

Extending down approximately 100 feet from the ground line and within the outer casing 14 is a flow casing or tubing 30 approximately 5½ inches in diameter. The flow tubing includes a lower segment **30*a* threadably connected thereto. The casing 30** defines a flow passage for well fluids in the direction of the arrows F up to the well head and then ultimately to conventional water separators and storage tanks.

The pony rod 28 is provided at its upper end with a knob 33 which fits in a union joint assembly 34 that is connected to the wire rope 35 through a conventional spelter fitting 36.

The stuffing gland assembly 22 comprises a cartridge 38 having an annular outer wall 39 and a shoulder 40. The upper end of the cartridge 38 is threadably connected to a detent cylinder 42 having an annular boss or detent 43 and a conventional dust seal 44. Fitted between the detent cylinder and the lower end of the cartridge 38 is a conventional packing gland comprising bearings 46 and packing or seals 47. As is readily understood by screwing the detent cylinder toward the bottom end of the cartridge 38 the packings 47 become radially expanded providing a tighter seal on the smooth surface of the polish rod.

The unique locking and sealing members are best illustrated in FIG. 2 and include a set of elastomeric rings 50 bonded to a metal ring 54 which positions the elastomers on opposite sides of a pair of drain ports 32 when the lower elastomer is seated against a shoulder 52 on the flow tubing segment **30*a*. The rings or elastomers 50 are made of an elastomer called Buna-N, a conventional elastomer used for sealing purposes. The ring 54 is provided with a circumferential outer groove 31 which joins the pair of ports 32. The ports 32** connect the interior of the flow tubing with a return passage for the well fluids to the bottom of the hole when the packing gland is removed, as shown by arrows D.

Positioned between the detent cylinder 42 and the flow tubing 30 is a torque tube 60 having an upper section **60*a* and a lower section 60*b* terminating in an end 56. The lower section 60*b* is provided with a shoulder 61 which is engagable with the shoulder 40 on the detent cylinder. The thread connection between section 60*a* and 60*b* is over-torqued so that the torque tube which extends above the ground can be threaded into the flow tubing 30 as at 62 and thus by rotation in one direction will be axially moved down into the well hole. The end 56 engages a thrust bearing 53. The thrust bearing 53 includes a pair of stainless steel rings 53*b* which are joined to a woven telflon-nylon separator 53*a*. The woven separator is of the type manufactured by Lear-Sigler under the tradename Fiberglide. The thrust bearing provides for relative rotational movement between the torque tube end 56 and the elastomeric rings 50. As the torque tube moves axially the rings 50 are compressed causing them to radially expand with a force of about 2,000 PSI and tightly grip and seal the packing gland in the flow tubing 30. The tighter the torque on the torque tube the tighter the seal and lock. To release the packing gland the torque tube is rotated in the opposite direction and is unscrewed thus allowing the natural resiliency of the rings 50 to radially retract them from the packing gland. As the shoulder 61 engages the shoulder 40** the torque tube raises the packing gland a slight distance if necessary to release the gland from the elastomeric rings in the event the rings are sticking to the packing gland.

The unique mechanism for grasping or snatching the packing gland once released includes a spring clip 70 formed of an incomplete circle (approximately 30° incomplete) which is formed so that it tightly fits around the diameter of the detent cylinder 42. The clip is housed in a groove 72 of a retainer 74 which is threaded to the union joint assembly 34. The spring clip is resilient enough to elastically deform and ride over the boss 43 into the position shown in FIG. 2 for grasping the packing gland. In normal operation, however, the clip never passes below the top of the detent cylinder during pumping. Once it does move over the boss 43, however, it tightly engages the packing gland so that when the gland is released from the flow tubing by radial retraction of the rings 50, raising of the polish rod will withdraw the packing gland by the upper end of the pony rod to above the ground.

The overall operation will now be described. A new packing gland is positioned on the pony rod 28 and the pony rod is coupled to the polish rod 26. The polish rod is then lowered into the flow tubing until the packing gland comes into the position shown in FIG. 2 some 100 feet below the ground. The packing gland is held in position on the pony rod by the spring clip 70. Once in position the operator rotates the torque tube 60 until the end 56 axially expands the elastomeric rings 50. The desired pressure, approximately 2,000 PSI, can be readily sensed by the operator during rotation of the torque tube. Once the torque reaches the desired limit the operator knows he has obtained a positive lock and seal on the packing gland. Next the union joint assembly 34 is raised by the pumper drawing the spring clip over the boss 43 and bringing the clip into its normal pumping position well above the end of the detent cylinder 42. Pumping then continues until the operator detects wear in the packing gland, which is generally evidenced by the presence of oil appearing on the polish rod. The pumping unit is then put in manual operation mode and the union joint assembly is lowered until the spring clip rides over the detent 43 and comes to rest in the position shown in FIG. 2. Next the operator unscrews the torque tube until the torque tube turns reasonably freely and at which time the operator knows he has released the elastomeric rings 50 from their grasping and sealing condition. Then the union joint assembly is raised, raising the polish rod and bringing the packing gland up with the pony rod above the ground surface. There will be a head of about 50 PSI on the oil below the packing gland. This oil would normally spill out into the wire rope cavity because of the packing gland having been removed. With removal of the packing gland in this invention, however, the drain ports 32 are exposed allowing the oil to circulate back down into the well hole so that the level of the oil in the well does not rise above the drain ports 32. Inspection and repair on the packing gland can then be easily made, the polish rod again lowered into the position shown in FIG. 2 and the elastomeric rings again tightened into their sealing and locking engagement to complete the operation.

While the preferred embodiments of the invention have been illustrated and described, it should be understood that variations will be apparent to one skilled in the art without departing from the principles herein. Accordingly, the invention is not to be limited to the specific embodiment illustrated in the drawing.

The embodiments of the invention in which a particular property or privilege is claimed are defined as follows:

1. Apparatus for releasably sealing a well hole at a location below ground surface comprising cylindrical production tube means extending into the well hole, a stuffing gland located in the production tube means several feet below the ground surface, said stuffing gland including an internal packing and an outer surface, a polish rod reciprocably mounted in engagement with the internal packing within the stuffing gland, an inner casing between the stuffing gland and the production tube means, resilient sealing and locking means separate from said internal packing and between the inner casing and said outer surface of the stuffing gland, and means extending above ground for radially expanding the sealing and locking means for sealing against production fluids passing between the inner casing and the outer surface of the stuffing gland and holding the stuffing gland in position below the ground surface.

2. The apparatus of claim 1, said means for radially expanding the sealing and locking means including a torque tube threadably joined to said inner casing for axial movement, said inner casing including a shoulder, said sealing and locking means including elastomeric rings seated on said shoulder and wherein axial movement of said torque tube radially expands the rings by squeezing the rings axially against said shoulder.

3. The apparatus of claim 2, wherein said rings are attached on either side of a metallic ring, said casing having a drain port aligned with said metallic ring, and said drain port communicating with said production tube when said stuffing gland is removed.

4. The apparatus of claim 2, said torque tube having an upper shoulder engagable with said stuffing gland to release the gland from said inner casing, and said torque tube including low-friction means abutting said elastomeric rings for allowing relative rotation between the torque tube and rings.

5. Apparatus for releasably sealing a well hole at a location below ground surface comprising:

cylindrical production tube means extending into the well hole, a stuffing gland located in the production tube means several feet below the ground surface, a polish rod reciprocably mounted within the stuffing gland, an inner casing between the stuffing gland and the production tube means, resilient sealing and locking means between the inner casing and said stuffing gland, said sealing and locking means including a set of axially spaced elastomeric rings, and a drain port between said rings and communicating with the well hole to drain production fluids back into the well hole when the stuffing gland is removed, and means extending above ground for radially expanding the sealing and locking means for sealing against production fluids passing between the inner casing and the stuffing gland and holding the stuffing gland in position below the ground surface.

6. Apparatus for releasably sealing a well hole at a location below ground surface comprising:

cylindrical production tube means extending into the well hole, a stuffing gland located in the production tube means several feet below the ground surface, and including a detent cylinder having a detent on its upper end, a polish rod reciprocably mounted with the stuffing gland, means for reciprocating said polish rod including a joint assembly having a snap clip expandable over said detent for coupling to said stuffing gland, whereby the stuffing gland can be raised after said sealing and locking means are relaxed by using the joint assembly of the polish rod reciprocating means, an inner casing between the stuffing gland and the production tube means, resilient sealing and locking means between the inner casing and said stuffing gland, and means extending above ground for radially expanding the sealing and locking means for sealing against production fluids passing between the inner casing and the stuffing gland and holding the stuffing gland in position below the ground surface.

7. The method of sealing and locking and removing a packing gland, having an internal packing, around a polish rod below ground in a well hole comprising radially expanding an elastomeric sealing and locking member separate from said internal packing into tight engagement between the packing gland and a stationary tube extending down from the top of the well hole externally of the packing gland; the step of expanding including rotating a second tube from above the ground surface and screwing the second tube downwardly into engagement with the elastomeric sealing and locking member for axially compressing the member to cause it to radially expand, unscrewing the second tube from above the ground surface to relax the elastomeric member and release the packing gland, withdrawing the packing gland, and separately adjusting the internal packing on the polish rod.

8. The method of sealing and locking and removing a packing gland around a polish rod below ground in a well hole comprising radially expanding an elastomeric sealing and locking member into tight engagement between the packing gland and a stationary tube extending down from the top of the well hole; the step of expanding including rotating a second tube from above the ground surface and screwing the second tube downwardly into engagement with the elastomeric sealing and locking member for axially compressing the sealing and locking member to cause it to radially expand, unscrewing the second tube from above the ground surface to relax the elastomeric sealing and locking member and release the packing gland and withdrawing the packing gland, the step of removing the packing gland including automatically coupling the packing gland to the polish rod and withdrawing the packing gland an polish rod simultaneously.

9. The method of sealing and locking and removing a packing gland around a polish rod below ground in a well hole comprising: radially expanding an elastomeric sealing and locking member into tight engagement between the packing gland and a stationary tube extending down from the top of the well hole; the step of expanding including rotating a second tube from above the ground surface and screwing the second tube downwardly into engagement with the elastomeric sealing and locking member for axially compressing the member to cause it to radially expand, unscrewing the second tube from above the ground surface to relax the elastomeric member and release the packing gland and withdrawing the packing gland; including the step of draining the stationary tube back into the well hole when the packing gland is withdrawn.

10. Apparatus for releasably sealing a well hole at a location below ground surface comprising:

a cylindrical production tube means extending into the well hole, a stuffing gland located in the production tube means several feet below the ground surface, a polish rod reciprocably mounted within the stuffing gland, an inner casing between the stuffing gland and the production tube means, resilient sealing and locking means between the inner casing and said stuffing gland, means extending above ground for radially expanding the sealing and locking means for sealing against production fluids passing between the inner casing and the stuffing gland and holding the stuffing gland in position below the ground surface, and a drain port exposed when said packing gland is removed for communicating with the well hole and the inner casing to drain production fluids back into the well hole when the packing gland is removed.

* * * * *